US011110409B1

(12) United States Patent
Hockmeyer et al.

(10) Patent No.: US 11,110,409 B1
(45) Date of Patent: Sep. 7, 2021

(54) PRODUCING PARTICLE DISPERSIONS

(71) Applicant: Hockmeyer Equipment Corp., Harrison, NJ (US)

(72) Inventors: Herman H. Hockmeyer, Saddle River, NJ (US); Barry W. Cullens, Elizabeth City, NC (US); Sean C. Kelleher, Aydlett, NC (US); Zachary P. Okelley, Edenton, NC (US); Dustin E. Thomas, Grandy, NC (US)

(73) Assignee: Hockmeyer Equipment Corp., Harrison, NJ (US)

( * ) Notice: Subject to any disclaimer, the term of this patent is extended or adjusted under 35 U.S.C. 154(b) by 37 days.

(21) Appl. No.: 16/884,280

(22) Filed: May 27, 2020

(51) Int. Cl.

| | |
|---|---|
| ***B01F 7/00*** | (2006.01) |
| ***B01F 3/12*** | (2006.01) |
| ***B01F 13/10*** | (2006.01) |
| ***B01F 15/02*** | (2006.01) |

(52) U.S. Cl.
CPC ..... *B01F 7/0075* (2013.01); *B01F 3/1221* (2013.01); *B01F 13/1016* (2013.01); *B01F 15/0283* (2013.01); *B01F 2003/125* (2013.01)

(58) Field of Classification Search
CPC ..... B01F 7/0075; B01F 3/1221; B01F 2003/125; B01F 13/1016; B01F 15/0283
See application file for complete search history.

(56) References Cited

U.S. PATENT DOCUMENTS

| | | | | |
|---|---|---|---|---|
| 8,376,252 | B1 | 2/2013 | Hockmeyer et al. | |
| 9,597,691 | B1 * | 3/2017 | Hockmeyer | B02C 17/1815 |
| 2006/0097093 | A1 * | 5/2006 | Hockmeyer | B02C 17/16 241/172 |
| 2015/0238913 | A1 * | 8/2015 | Luharuka | B01F 7/00641 366/138 |

* cited by examiner

*Primary Examiner* — Anshu Bhatia
(74) *Attorney, Agent, or Firm* — Arthur Jacob

(57) ABSTRACT

A particle-carrying feedstock is mixed by a rotor-stator mixing mechanism placed within a mixing chamber where mixing is conducted under a negative pressure for separating and removing entrained air from the mixed feedstock, preferably before passing the de-aerated mixed feedstock to a media mill for processing into a particle dispersion. The rotor of the rotor-stator mixing mechanism preferably includes a disk carrying vanes on opposite faces of the disk for a conducting simultaneous dual mixing operations. Openings in the stator are provided with an H-shaped cross-sectional configuration and are intermingled for facilitating the mixing operation while maintaining the integrity of the rotor-stator mixing mechanism.

14 Claims, 4 Drawing Sheets

PRODUCING PARTICLE DISPERSIONS

The present invention relates generally to producing dispersions of finely divided particles within a liquid carrier and pertains, more specifically, to an improvement employed in connection with processing particle-carrying feedstock, preferably in a system that utilizes a media mill containing a bed of media through which the feedstock is passed.

Conventional media mills of the type in which particle-carrying feedstock is passed through a bed of media have been in use for a very long time and have demonstrated an ability to produce high quality particle dispersions with consistent reliability. More recent improvements, such as those described in U.S. Pat. Nos. 8,376,252 and 9,597,691, the disclosures of which are incorporated herein by reference thereto, have proved to provide further advances in the attainment of finer dispersions of consistent high quality with reduced processing times.

The present invention provides an improvement through the incorporation of a rotor-stator mixer, preferably in a system utilizing a media mill for processing a feedstock. Rotor-stator mixers have been in use for the rapid mixing of a wide variety of constituents. These rotor-stator mixers employ an impeller, or rotor, rotated at high speed within a surrounding stationary shroud, or stator, located in close proximity to the rotor and having openings of various size, shape and arrangement to allow feedstock being processed to pass through subsequent to undergoing intense shear. While these rotor-stator mixers achieve rapid dispersion, the resulting dispersion produced by such high speed processing will contain unwanted entrained air, including air dispersed microscopically throughout the dispersion. Such entrained air is detrimental to the quality of the dispersion and requires removal in order to complete the desired particulate dispersion. Ordinarily, effective removal of such entrained air requires the addition of excessive periods of time to complete the dispersion process.

The present invention enables the adoption of the high speed mixing ability of a rotor-stator mixer in the production of a particulate dispersion, without incurring the disadvantage of time-consuming removal of entrained air inherent in connection with the operation of conventional rotor-stator mixers. As such, the present invention attains several objects and advantages, some of which are summarized as follows: Enables an ongoing reduction of air ordinarily entrained in particle-carrying feedstock during utilization of a rotor-stator mixing operation in the preparation of a particulate dispersion, thereby achieving a more consistently uniform dispersion; completes a particulate dispersion of greater purity, stability and appearance; allows added flexibility in the construction and operation of a system for producing particulate dispersions of increased quality, with the expenditure of decreased processing time; avoids the necessity for overly complex apparatus and procedures in order to produce high quality particulate dispersions; enables a system and method that combine the operation of a rotor-stator mixer with a media mill to produce a particulate dispersion essentially free of entrained air and thus exhibiting uniform, high quality; simplifies the construction and operation of a particle dispersion processing system for increased economy and long-term reliability.

The above objects and advantages, as well as further objects and advantages, are attained by the present invention which may be described briefly as an improvement in a system for producing a particle dispersion utilizing a media mill for processing particle-carrying feedstock passed from a supply of mixed feedstock to the media mill, the improvement comprising: a mixing chamber having a chamber wall providing the mixing chamber with a limited volume; a rotor-stator mixing mechanism enclosed within the limited volume of the mixing chamber for mixing particle-carrying feedstock prior to passage of mixed feedstock to the media mill, the rotor-stator mechanism having a rotor arranged for rotation within a stator during a mixing operation; the stator having an inner peripheral surface juxtaposed with the rotor, an outer peripheral surface spaced radially outwardly from the inner peripheral surface, and a plurality of openings for passing mixed feedstock radially through the stator, from the rotor into the mixing chamber; the chamber wall having a wall portion extending around and in close juxtaposition with the outer peripheral surface of the stator; an inlet passage in communication with the rotor for delivering the particle-carrying feedstock to the rotor for mixing, whereby mixed feedstock is delivered from the rotor through the stator to the limited volume of the mixing chamber; an outlet conduit communicating with the mixing chamber for delivering the mixed feedstock from the mixing chamber; and a pumping mechanism communicating with the mixing chamber for establishing a negative pressure within the limited volume of the mixing chamber during the mixing operation, whereby air entrained within the particle-carrying feedstock is expanded for separation and removal from the mixed particle-carrying feedstock, prior to delivery of the mixed feedstock to the media mill.

In addition, the present invention includes an improvement for processing particle-carrying feedstock to produce a mixed feedstock, the improvement comprising: a mixing chamber having a chamber wall providing the mixing chamber with a limited volume; a rotor-stator mixing mechanism enclosed within the minimum volume of the mixing chamber for mixing the particle-carrying feedstock, the rotor-stator mechanism having a rotor arranged for rotation within a stator during a mixing operation; the stator having an inner peripheral surface juxtaposed with the rotor, an outer peripheral surface spaced radially outwardly from the inner peripheral surface, and a plurality of openings for passing mixed feedstock radially through the stator, from the rotor into the mixing chamber; the chamber wall having a wall portion extending around and in close juxtaposition with the outer peripheral surface of the stator; an inlet passage in communication with the rotor for delivering the particle-carrying feedstock to the rotor for mixing, whereby mixed feedstock is delivered from the rotor to the limited volume of the mixing chamber; an outlet conduit communicating with the mixing chamber for delivering the mixed feedstock from the mixing chamber; and a pumping mechanism communicating with the mixing chamber for establishing a negative pressure within the limited volume of the mixing chamber during the mixing operation, whereby air entrained within the particle-carrying feedstock is expanded for separation and removal from the mixed feedstock.

Further, the present invention includes an improvement in a method for producing a particle dispersion utilizing a media mill for processing particle-carrying feedstock passed from a supply of mixed feedstock to the media mill, the improvement comprising: providing a mixing chamber with a chamber wall dimensioned such that the mixing chamber has a limited volume; mixing particle-carrying feedstock within the limited volume of the mixing chamber with a rotor-stator mixing mechanism enclosed within the limited volume of the mixing chamber, prior to passage of mixed feedstock to the media mill, the rotor-stator mechanism having a rotor arranged for rotation within a stator during a mixing operation; providing the stator with an inner peripheral surface juxtaposed with the rotor, an outer peripheral surface spaced radially outwardly from the inner peripheral surface, and a plurality of openings extending through the stator from the inner peripheral surface to the outer peripheral surface; passing mixed feedstock radially through the openings in the stator, from the rotor into the mixing chamber; extending the chamber wall around and in close juxtaposition with the outer peripheral surface of the stator; delivering particle-carrying feedstock to the rotor for mixing, whereby mixed feedstock is delivered from the rotor through the stator, to the limited volume of the mixing chamber; and establishing a negative pressure within the limited volume of the mixing chamber during the mixing operation, whereby air entrained within the particle-carrying feedstock is expanded for separation and removal from the mixed feedstock, prior to delivery of the mixed feedstock to the media mill.

Still further, the present invention includes an improvement for processing particle-carrying feedstock to produce a mixed feedstock, the improvement comprising: providing a mixing chamber with a chamber wall dimensioned such that the mixing chamber has a limited volume; mixing particle-carrying feedstock within the limited volume of the mixing chamber with a rotor-stator mixing mechanism enclosed within the limited volume of the mixing chamber, the rotor-stator mechanism having a rotor arranged for rotation within a stator during a mixing operation; providing the stator with an inner peripheral surface juxtaposed with the rotor, an outer peripheral surface spaced radially outwardly from the inner peripheral surface, and a plurality of openings extending through the stator from the inner peripheral surface to the outer peripheral surface; passing mixed feedstock radially through the openings in the stator, from the rotor into the mixing chamber; extending the chamber wall around and in close juxtaposition with the outer peripheral surface of the stator; delivering particle-carrying feedstock to the rotor for mixing, whereby mixed feedstock is delivered from the rotor through the stator, to the limited volume of the mixing chamber; and establishing a negative pressure within the limited volume of the mixing chamber during the mixing operation, whereby air entrained within the particle-carrying feedstock is expanded for separation and removal from the mixed feedstock.

Additionally, the present invention includes a rotor-stator mixing mechanism for mixing feedstock, the rotor-stator mechanism comprising: a rotor comprising a disk including axially opposite faces, and a corresponding set of vanes extending radially along each of the opposite faces from a corresponding central input toward a perimetric edge of the rotor; and a stator extending circumferentially around the perimetric edge of the rotor, in juxtaposition with the vanes of each corresponding set of vanes; the stator having an inner peripheral surface juxtaposed with the perimetric edge of the rotor, an outer peripheral surface spaced radially outwardly from the inner peripheral surface, and a plurality of openings extending from the inner peripheral surface to the outer peripheral surface for passing mixed feedstock radially through the stator.

Further, the present invention includes, in a rotor-stator mixing mechanism including a rotor having a central input, a perimetric edge spaced radially from the central input, and a stator extending circumferentially around the perimetric edge of the rotor, the stator having an inner peripheral surface juxtaposed with the perimetric edge of the rotor, an outer peripheral surface spaced radially outwardly from the inner peripheral surface, and a plurality of openings extending from the inner peripheral surface to the outer peripheral surface for passing mixed feedstock radially through the stator, an improvement wherein openings of the plurality of openings in the stator are configured in the shape of a letter H and the so-configured openings are intermingled with one-another within the stator.

The invention will be understood more fully, while still further objects and advantages will become apparent, in the following detailed description of preferred embodiments of the invention illustrated in the accompanying drawing, in which.

Figure 1:
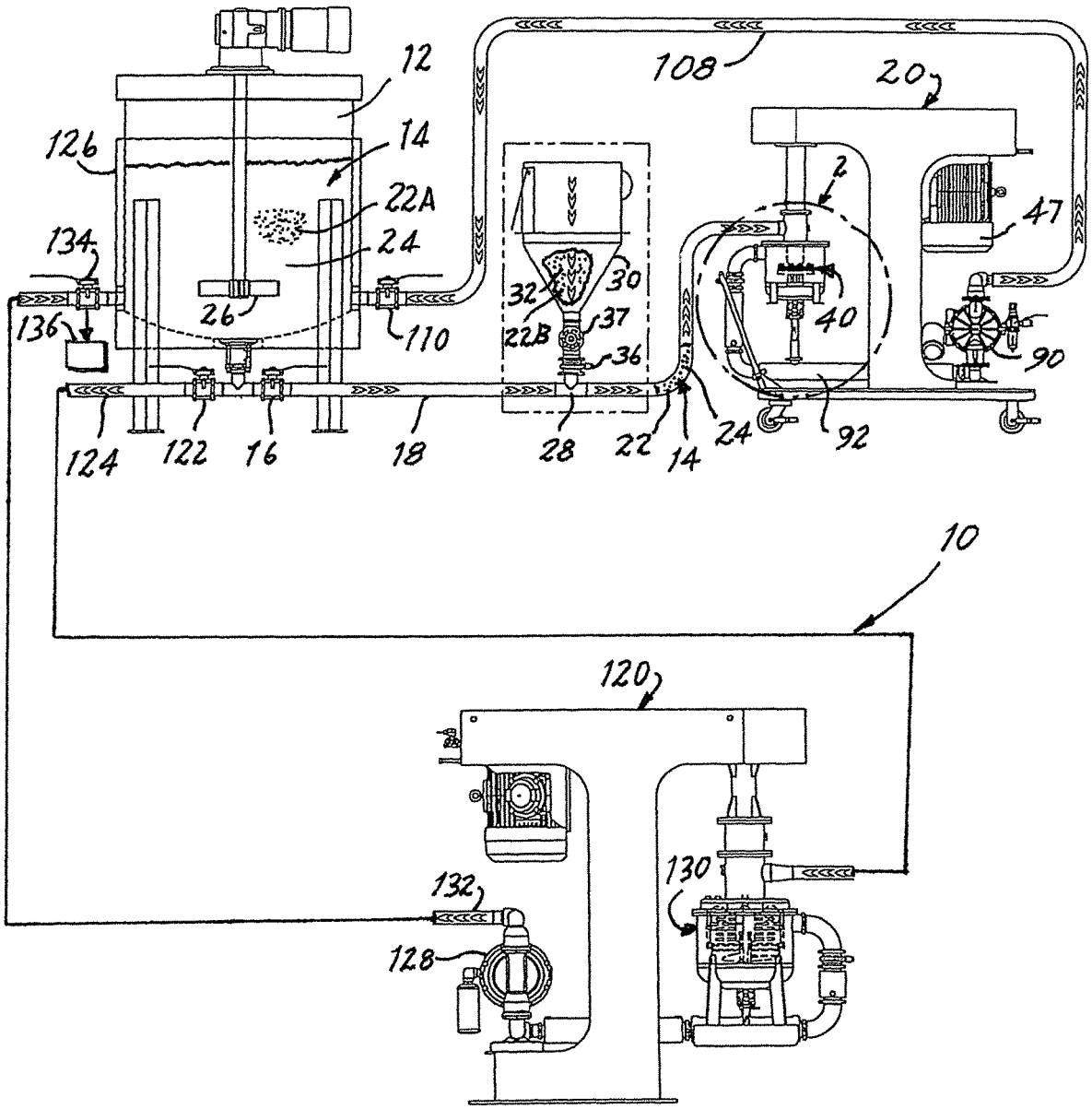
FIG. 1 is an elevational view, partially diagrammatic, illustrating a system incorporating improvements of the present invention and operating in accordance with methods of the present invention.
Figure 2:
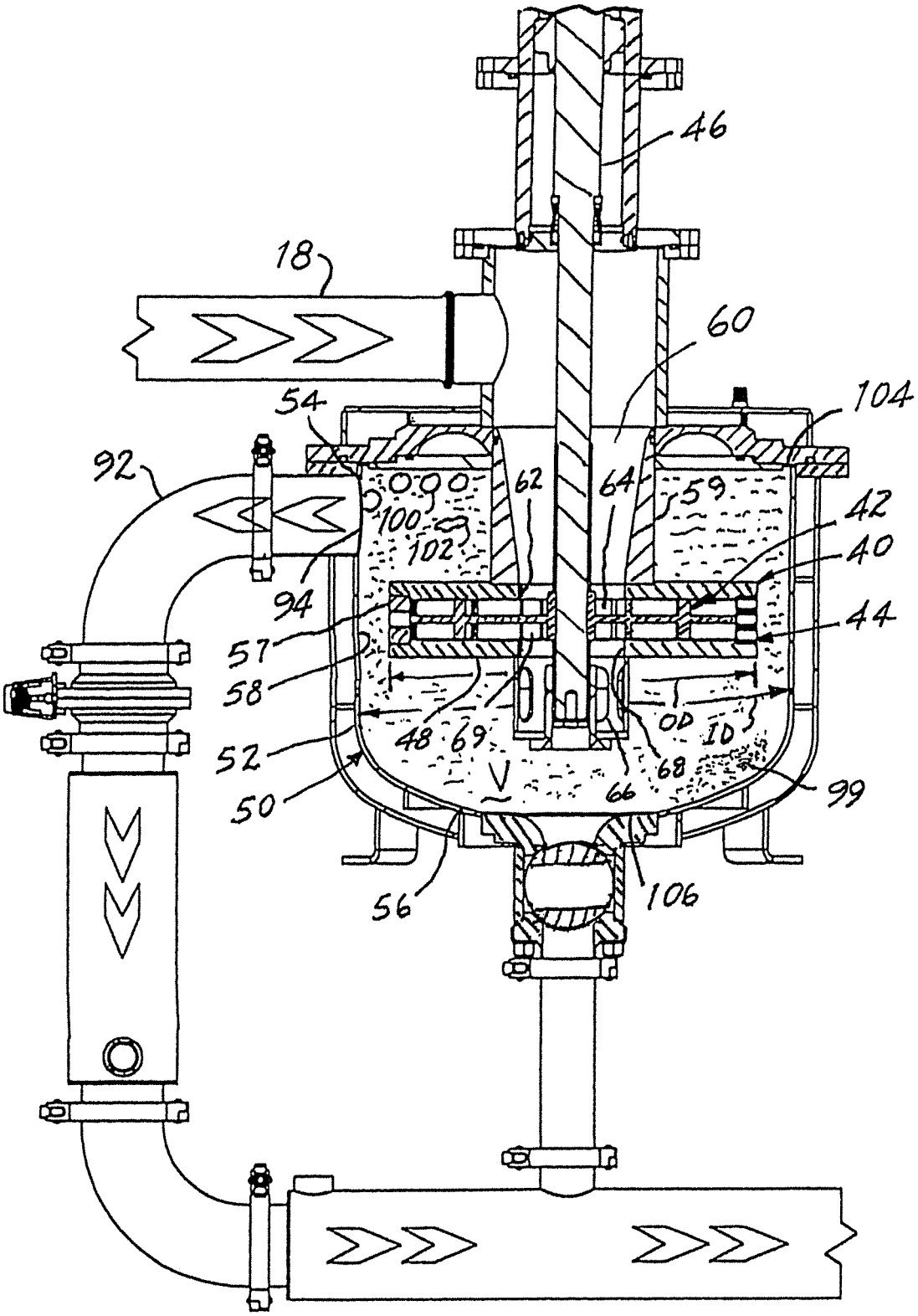
FIG. 2 is an enlarged, fragmentary, partially diagrammatic cross-sectional view of a portion of FIG. 1 designated by arrow 2 in FIG. 1.

Referring now to the drawing, and especially to FIGS. 1 and 2 thereof, a system constructed and operating in accordance with the present invention is shown at 10 and is seen to include a supply vessel in the form of a tank 12 carrying a supply of feedstock 14. Upon opening a first input valve 16, feedstock 14 is directed through a first feed conduit 18 to a mixing station 20. Upon arrival at the mixing station 20, feedstock 14 includes powder constituents 22 carried within a liquid medium 24, either by having added powder constituents to the liquid medium 24 while within the tank 12, as illustrated by powder constituents 22A, where such powder constituents 22A can be combined with liquid medium 24, optionally with the assistance of an agitator 26, or by introduction into the liquid medium 24, as at a location 28, from a hopper 30 containing a supply 32 of powder constituents 22B, through a doser 37 and an open shut-off valve 36 into the liquid medium 24.

Feedstock 14, in particle-carrying liquid form, then is fed to a rotor-stator mixing mechanism 40 having an impeller, shown in the form of a rotor 42, arranged to rotate within a surrounding shroud, shown in the form of a stator 44, the rotor 42 being affixed to a drive shaft 46 coupled to a drive motor 47 for high-speed rotation, preferably wherein the peripheral speed of rotor 42 is within a range of 3,000 to 12,000 feet per minute, within a housing 48 that carries the stationary surrounding stator 44.

A mixing chamber 50 encloses the rotor-stator mixing mechanism 40 and has a chamber wall 52 extending vertically between an upper end 54 and a lower end 56 establishing a relatively small, limited internal volume V of the mixing chamber 50 surrounding the rotor-stator mixing mechanism 40, wherein the outside diameter OD of the outer peripheral surface 57 of the stator 44 preferably occupies about eighty to ninety percent of the inside diameter ID of the adjacent portion 58 of chamber wall 52. A tubular support member 59 supports housing 48 within mixing chamber 50, spaced away from upper and lower ends 54 and 56, and provides an inlet passage 60 communicating with an upper opening 62 in housing 48 leading to a first, or upper input 64 of rotor 42, while further inlet passages 66 communicate with a lower opening 68 in housing 48 leading to a second, or lower input 69 of rotor 42, so as to establish communication with the limited internal volume V of the mixing chamber 50, as described more fully below.

Figure 3:
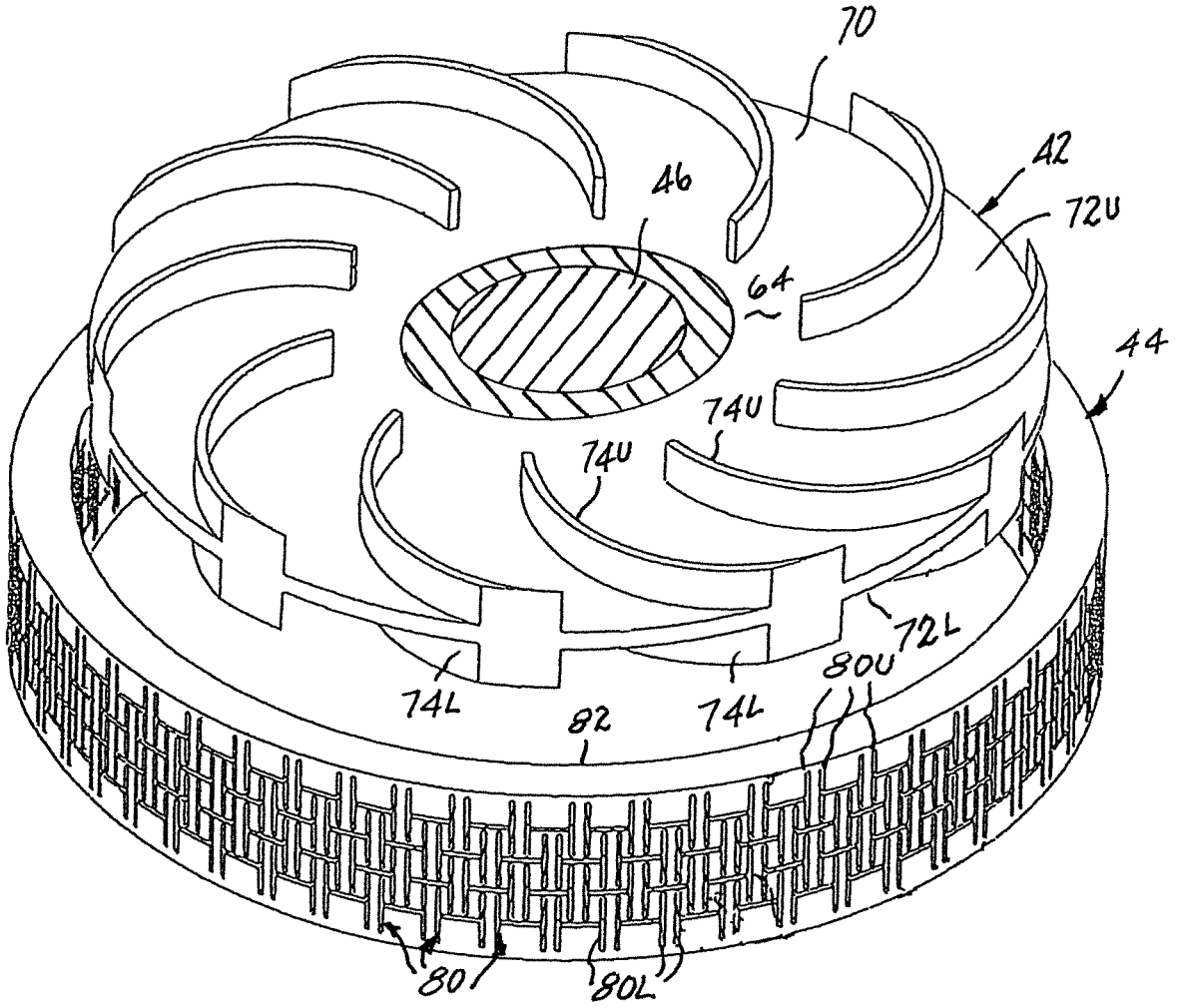
FIG. 3 is an enlarged, exploded perspective view of certain component parts of an apparatus constructed in accordance with the invention.

With further reference to FIG. 3, in the preferred construction, rotor 42 is provided with a "dual" configuration, comprised of a disk 70 having axially opposite faces, shown in the form of upper face 72U and lower face 72L. A corresponding set of vanes extend radially along each face 72U and 72L, such that upper input 64 of rotor 42 communicates with corresponding upper vanes 74U, and lower input 69 communicates with corresponding lower vanes 74L. Surrounding stator 44 includes openings 80 through which openings 80 feedstock 14 passes during the conduct of a mixing operation. In the preferred arrangement, feedstock 14 is first directed by inlet passage 60 to upper input 64 of rotor 42 for intense mixing by the action of upper vanes 74U and adjacent upper openings 80U in stator 44, prior to passing into mixing chamber 50. Once having passed through openings 80U, feedstock 14 is passed through lower input 69 to be subjected to further intense mixing by the action of lower vanes 74L and adjacent lower openings 80L, thereby effecting simultaneous dual mixing operations. In the preferred construction, all of the openings 80 are provided with a cross-section configured in the shape of a letter H, and the H-shaped openings 80 are intermingled, as shown, throughout the stator 44 so as to promote, together with the close proximity of the rotor 42 to the inner peripheral surface 82 of the stator 44, an efficacious, intense shear for mixing of the constituents of feedstock 14 and subsequent escape of the feedstock 14 into mixing chamber 50 while, at the same time, maintaining the integrity of the stator 44 and the rotor-stator mixing mechanism 40 itself.

A pumping mechanism, shown in the form of a pump 90 communicates with the limited internal volume V of mixing chamber 50 through communication with a first outlet conduit 92 leading from an outlet 94 from the mixing chamber 50. Pump 90 draws feedstock 14 through first feed conduit 18, into inlet passage 60 for delivery into upper input 64 for the conduct of effective mixing by intense shear carried out by the action of upper vanes 74U in concert with upper openings 80U. Then, feedstock 14 is passed through further inlet passages 66 and lower opening 68 into lower input 69 of rotor 42 to be subjected to intense shear by the action of lower vanes 74L in concert with lower openings 80L, thereby accomplishing highly effective mixing. At the same time, pump 90 establishes a negative pressure, preferably within the range of approximately ten to thirty inches of vacuum, within mixing chamber 50, assisted by the limited internal volume V of mixing chamber 50, whereby air entrained within the feedstock 14 is expanded for allowing effective separation and removal. Thus, as is usual in the preparation of particle dispersions, upon the introduction of powder constituents 22 into liquid medium 24 to create feedstock 14, air also is admitted into the feedstock 14. The inclusion of air in a finished particle dispersion is detrimental to the quality of the dispersion; hence, procedures have been developed for the removal of such air as a part of the preparation of a completed dispersion. These procedures usually require extra processing steps, are time-consuming and result in added expense. The present improvement avoids the necessity for such time-consuming, added air removal procedures, while completing a particle dispersion of exceptional high quality.

As a result of the aforesaid negative pressure established within the mixing chamber 50, air entrained within the feedstock 14 being processed by the rotor-stator mixing mechanism 40, including such air entrained in microscopic deposits 99, will expand, creating relatively larger bubbles 100 that rise toward the outlet 94 for exiting mixing chamber 50 along with the thoroughly mixed feedstock 14. Likewise, any voids 102 created by the intense mixing created by the action of rotor-stator mixing mechanism 40 will leave mixing chamber 50 to travel along first outlet conduit 92 to be returned, through a return conduit 108 and first entrance valve 110, to tank 12, where the bubbles 100 will rise to leave mixed feedstock 14, and voids 102 will dissipate. In order to facilitate the exit of bubbles 100 from mixing chamber 50, outlet 94 is located at an elevated level with respect to the limited internal volume of mixing chamber 50, juxtaposed with the top 104 of mixing chamber 50, enabling bubbles 100 to rise and expand, thereby facilitating the separation and passage of air out of mixing chamber 50.

Rotor-stator mixing mechanism 40 advantageously is placed in a horizontal orientation, intermediate the top 104 and bottom 106 of mixing chamber 50 so as to enable an effective mixing operation by the dual configuration of rotor 42. The feedstock 14 will be re-circulated through mixing station 20 over as many cycles of operation as may be necessary to attain a desired mixture of finely divided particles in feedstock 14 contained within tank 12, ready for further processing, such as in processing station 120 of system 10.

Further processing of feedstock 14 is conducted, in system 10, within processing station 120 by closing first input valve 16 and first entrance valve 110, and opening a second input valve 122 to deliver de-aerated feedstock 14, as initially processed at mixing station 20, from tank 12, through a second input conduit 124 to processing station 120. Tank 12 is provided with a cooling jacket 126 so as to maintain control over the temperature of feedstock 14 during processing, whether such processing is conducted within mixing station 20 or processing station 120. As described more fully in the afore-cited U.S. Pat. No. 9,597,691, a pumping mechanism 128 of processing station 120 draws feedstock 14 into a media mill 130 which processes feedstock 14 to complete a desired high quality dispersion. During a processing operation, feedstock 14 is returned to tank 12 through a second outlet conduit 132 and a valve 134 which serves as a second entrance valve, and feedstock 14 is re-circulated through as many cycles as is necessary to complete a desired dispersion. Valve 134 is a three-way valve so that upon completion, the finished dispersion is diverted by valve 134 for delivery at 136.

Figure 4:
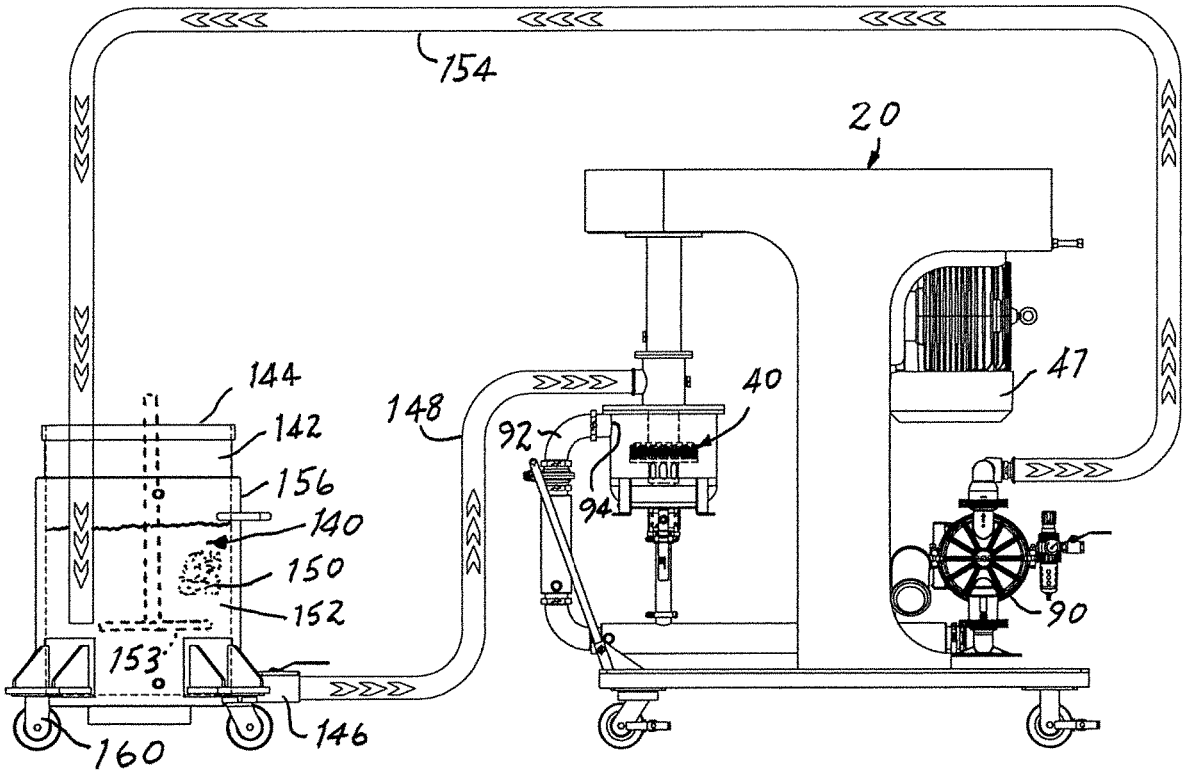
FIG. 4 is an elevational view, partially diagrammatic, illustrating another embodiment of the present invention, operating in accordance with methods of the present invention.

In an alternate arrangement illustrated in FIG. 4, mixing station 20 is provided with feedstock 140 from a supply vessel in the form of a container 142, open at the top 144, and carrying a supply of feedstock 140. Upon opening an input valve 146, feedstock 140 is directed through a feed conduit 148 to mixing station 20. Upon arrival at the mixing station 20, feedstock 140 includes a mixture of powder constituents 150 carried within a liquid medium 152 by having added powder constituents to the liquid medium 152, mixed by agitation, as by an optional agitator 153, while within the container 142. Once mixed in mixing station 20, as set forth above in connection with the detailed description of a mixing operation conducted in mixing station 20, feedstock 140 is returned, through return conduit 154, to container 142. As described above in connection with system 10, container 142 is provided with a cooling jacket 156 for cooling feedstock 140 during the mixing operation where feedstock 140 is being circulated through cycles of mixing during a mixing operation. When a mixing operation is complete, return conduit 154 is withdrawn from container 142 and feed conduit 148 is uncoupled from container 142 for convenient transport of container 142, and prepared feedstock 140 within container 142, as facilitated by an integrated carriage 160, for storage or for delivery of feedstock 140 for further processing.

It will be seen that the present invention attains all of the objects and advantages summarized above, namely: Enables an ongoing reduction of air ordinarily entrained in particle-carrying feedstock during utilization of a rotor-stator mixing operation in the preparation of a particulate dispersion, thereby achieving a more consistently uniform dispersion; completes a particulate dispersion of greater purity, stability and appearance; allows added flexibility in the construction and operation of a system for producing particulate dispersions of increased quality, with the expenditure of decreased processing time; avoids the necessity for overly complex apparatus and procedures in order to produce high quality particulate dispersions; enables a system and method that combine the operation of a rotor-stator mixer with a media mill to produce a particulate dispersion essentially free of entrained air and thus exhibiting uniform, high quality; simplifies the construction and operation of a particle dispersion processing system for increased economy and long-term reliability.

It is to be understood that the above detailed description of preferred embodiments of the invention is provided by way of example only. Various details of design, construction and procedure may be modified without departing from the true spirit and scope of the invention as set forth in the appended claims.

The embodiments of the invention in which an exclusive property or privilege is claimed are defined as follows:

1. An improvement in a system for producing a particle dispersion utilizing a media mill for processing particle-carrying feedstock passed from a supply of mixed feedstock from which entrained air has been removed to the media mill, the improvement comprising:

a mixing chamber extending between a lower bottom and an upper top and having a chamber wall providing the mixing chamber with a limited volume;

a rotor-stator mixing mechanism placed within the limited volume of the mixing chamber for mixing particle-carrying feedstock to establish the supply of mixed feedstock prior to passage of mixed feedstock to the media mill, the rotor-stator mixing mechanism being located intermediate and spaced from the lower bottom and the upper top of the mixing chamber, the rotor-stator mixing mechanism having a shroud, and an impeller arranged for rotation within the shroud during a mixing operation;

the shroud having an inner peripheral surface juxtaposed with the impeller, and a plurality of openings extending through the shroud outwardly from the inner peripheral surface for passing particle-carrying feedstock from the impeller through the shroud and into the mixing chamber;

the chamber wall having a wall portion surrounding and in close juxtaposition with the shroud;

an inlet passage in communication with the impeller for delivering the particle-carrying feedstock to the impeller for advancement by the impeller through the shroud into the mixing chamber, whereby mixed feedstock is delivered to the limited volume of the mixing chamber;

a pumping mechanism communicating with the mixing chamber for establishing a negative pressure within the limited volume of the mixing chamber during the mixing operation, whereby air entrained within the mixed feedstock is expanded for separation from the mixed feedstock in the mixing chamber;

an outlet conduit communicating with the mixing chamber adjacent the upper top of the mixing chamber at a level elevated with respect to the limited volume, for facilitating carrying air separated from the mixed feedstock out of the mixing chamber while delivering the mixed feedstock from the mixing chamber prior to delivery of the mixed feedstock to the media mill; and wherein the rotor-stator mixing mechanism includes a housing having axially opposite first and second inlet openings;

the impeller is placed within the housing and comprises a disk including axially opposite first and second faces, and first and second sets of vanes, each one set of vanes extending toward the shroud along a corresponding one of the opposite first and second faces from a corresponding one of first and second inputs each communicating with a corresponding one of the first and second inlet openings; and the shroud extends circumferentially around the impeller, in juxtaposition with the vanes of each set of the corresponding sets of vanes, and the plurality of openings that extend through the shroud include first openings juxtaposed with the first set of vanes, and second openings juxtaposed with the second set of vanes.

2. The improvement of claim 1 wherein the negative pressure is within a range of approximately ten to thirty inches of vacuum.

3. The improvement of claim 1 wherein the pumping mechanism communicates with the outlet conduit for effecting delivery of the mixed feedstock from the mixing chamber.

4. The improvement of claim 1 wherein the wall portion of the mixing chamber wall includes an inside diameter of a given dimension, and the shroud includes an outside diameter placed within the inside diameter, the outside diameter being dimensioned between about eighty to ninety percent of the given dimension.

5. The improvement of claim 1 wherein openings of the plurality of openings that extend through the shroud are configured in the shape of a letter H and are intermingled with one-another within the shroud.

6. The improvement of claim 1 wherein the first inlet opening is in communication with a supply of feedstock and with the first input for passing feedstock from the supply of feedstock to the first set of vanes and subsequent passage through the first set of openings that extend through the shroud into the mixing chamber, and the second inlet opening is in communication with the mixing chamber and the second input for passing mixed feedstock from the mixing chamber to the second set of vanes for subsequent return, through the second set of openings that extend through the shroud, into the mixing chamber.

7. An improvement for processing particle-carrying feedstock to produce a supply of mixed feedstock from which air entrained within the particle-carrying feedstock has been removed, the improvement comprising:

a mixing chamber extending between a lower bottom and an upper top and having a chamber wall providing the mixing chamber with a limited volume;

a rotor-stator mixing mechanism placed within the limited volume of the mixing chamber for mixing the particle-carrying feedstock, the rotor-stator mixing mechanism being located intermediate and spaced from the lower bottom and the upper top of the mixing chamber, the rotor-stator mixing mechanism having a shroud and an impeller arranged for rotation within the shroud during a mixing operation;

the shroud having an inner peripheral surface juxtaposed with the impeller, and a plurality of openings extending through the shroud outwardly from the inner peripheral surface to the mixing chamber for passing mixed particle-carrying feedstock through the shroud, from the impeller into the mixing chamber;

the chamber wall having a wall portion surrounding and in close juxtaposition with the outer peripheral surface of the shroud;

an inlet passage in communication with the impeller for delivering the particle-carrying feedstock to the impeller for passage through the openings extending through the shroud, whereby mixed feedstock is delivered from the shroud to the limited volume of the mixing chamber;

a pumping mechanism communicating with the mixing chamber for establishing a negative pressure within the limited volume of the mixing chamber during the mixing operation, whereby air entrained within the mixed feedstock in the mixing chamber is expanded for separation from the mixed feedstock;

an outlet conduit communicating with the mixing chamber adjacent the upper top of the mixing chamber at a level elevated with respect to the limited volume, for facilitating carrying expanded air separated from the mixed feedstock out of the mixing chamber while delivering mixed feedstock from the mixing chamber; and wherein openings of the plurality of openings that extend through the shroud are configured in the shape of a letter H and are intermingled with one-another within the shroud.

8. An improvement for processing particle-carrying feedstock to produce a supply of mixed feedstock from which air entrained within the particle-carrying feedstock has been removed, the improvement comprising:

a mixing chamber extending between a lower bottom and an upper top and having a chamber wall providing the mixing chamber with a limited volume;

a rotor-stator mixing mechanism placed within the limited volume of the mixing chamber for mixing the particle-carrying feedstock, the rotor-stator mixing mechanism being located intermediate and spaced from the lower bottom and the upper top of the mixing chamber, the rotor-stator mixing mechanism having a shroud and an impeller arranged for rotation within the shroud during a mixing operation;

the shroud having an inner peripheral surface juxtaposed with the impeller, and a plurality of openings extending through the shroud outwardly from the inner peripheral surface to the mixing chamber for passing mixed particle-carrying feedstock through the shroud, from the impeller into the mixing chamber;

the chamber wall having a wall portion surrounding and in close juxtaposition with the outer peripheral surface of the shroud;

an inlet passage in communication with the impeller for delivering the particle-carrying feedstock to the impeller for passage through the openings extending through the shroud, whereby mixed feedstock is delivered from the shroud to the limited volume of the mixing chamber;

a pumping mechanism communicating with the mixing chamber for establishing a negative pressure within the limited volume of the mixing chamber during the mixing operation, whereby air entrained within the mixed feedstock in the mixing chamber is expanded for separation from the mixed feedstock;

an outlet conduit communicating with the mixing chamber adjacent the upper top of the mixing chamber at a level elevated with respect to the limited volume, for facilitating carrying expanded air separated from the mixed feedstock out of the mixing chamber while delivering mixed feedstock from the mixing chamber; and wherein the rotor-stator mixing mechanism includes a housing having axially opposite first and second inlet openings;

the impeller is placed within the housing and comprises a disk including axially opposite first and second faces, and first and second sets of vanes, each one set of vanes extending toward the shroud along a corresponding one of the opposite first and second faces from a corresponding one of first and second inputs juxtaposed with a corresponding one of the first and second inlet openings; and the shroud extends circumferentially around the impeller, in juxtaposition with the vanes of each set of the corresponding sets of vanes, and the plurality of openings that extend through the shroud include first openings juxtaposed with the first set of vanes, and second openings juxtaposed with the second set of vanes.

9. The improvement of claim 8 wherein openings of the plurality of openings that extend through the shroud are configured in the shape of a letter H and are intermingled with one-another within the shroud.

10. The improvement of claim 8 wherein the first inlet opening is in communication with a supply of feedstock and with the first input for passing feedstock from the supply of feedstock to the first set of vanes and subsequent passage through the first set of openings that extend through the shroud into the mixing chamber, and the second inlet opening is in communication with the mixing chamber and the second input for passing mixed feedstock from the mixing chamber to the second set of vanes for subsequent return, through the second set of openings that extend through the shroud, into the mixing chamber.

11. The improvement of claim 8 wherein the negative pressure is within a range of approximately ten to thirty inches of vacuum.

12. The improvement of claim 11 wherein the pumping mechanism communicates with the outlet conduit for effecting delivery of the mixed feedstock from the mixing chamber.

13. The improvement of claim 8 wherein the wall portion of the mixing chamber wall includes an inside diameter of a given dimension, and the shroud includes an outside diameter placed within the inside diameter, the outside diameter being dimensioned between eighty to ninety percent of the given dimension.

14. An improvement for processing particle-carrying feedstock to produce a supply of mixed feedstock from which air entrained within the particle-carrying feedstock has been removed, the improvement comprising:

a mixing chamber extending between a lower bottom and an upper top and having a chamber wall providing the mixing chamber with a limited volume;

a rotor-stator mixing mechanism placed within the limited volume of the mixing chamber for mixing the particle-carrying feedstock, the rotor-stator mixing mechanism being located intermediate and spaced from the lower bottom and the upper top of the mixing chamber, the rotor-stator mixing mechanism having a shroud and an impeller arranged for rotation within the shroud during a mixing operation;

the shroud having an inner peripheral surface juxtaposed with the impeller, and a plurality of openings extending through the shroud outwardly from the inner peripheral surface to the mixing chamber for passing mixed particle-carrying feedstock through the shroud, from the impeller into the mixing chamber;

the chamber wall having a wall portion surrounding and in close juxtaposition with the outer peripheral surface of the shroud;

an inlet passage in communication with the impeller for delivering the particle-carrying feedstock to the impeller for passage through the openings extending through the shroud, whereby mixed feedstock is delivered from the shroud to the limited volume of the mixing chamber;

a pumping mechanism communicating with the mixing chamber for establishing a negative pressure within the limited volume of the mixing chamber during the mixing operation, whereby air entrained within the mixed feedstock in the mixing chamber is expanded for separation from the mixed feedstock;

an outlet conduit communicating with the mixing chamber adjacent the upper top of the mixing chamber at a level elevated with respect to the limited volume, for facilitating carrying expanded air separated from the mixed feedstock out of the mixing chamber while delivering mixed feedstock from the mixing chamber; and wherein openings of the plurality of openings that extend through the shroud are configured in the shape of a letter H and are intermingled with one-another within the shroud.

* * * * *